United States Patent [19]

Jodrey et al.

[11] 4,411,393

[45] Oct. 25, 1983

[54] WEB TENSION CONTROL APPARATUS

[75] Inventors: Robert M. Jodrey, Westboro; Robert J. Scott, Framingham, both of Mass.

[73] Assignee: Dennison Manufacturing Company, Framingham, Mass.

[21] Appl. No.: 270,935

[22] Filed: Jun. 5, 1981

[51] Int. Cl.[3] ..... B65H 17/02; B65H 17/38; B65H 23/08; B65H 25/04

[52] U.S. Cl. ..... 242/75.43; 242/75.53; 226/29; 226/45; 226/86

[58] Field of Search ..... 242/75.43, 75.53, 67.2; 226/10, 24, 28–31, 76, 86, 44, 45

[56] References Cited

U.S. PATENT DOCUMENTS

| | | | |
|---|---|---|---|
| 2,893,053 | 7/1959 | Powell | 242/75.53 X |
| 3,446,451 | 5/1969 | Wilcox | 242/75.43 |
| 3,630,463 | 12/1971 | Mistele | 242/75.43 |
| 3,892,344 | 7/1975 | Corse | 226/44 |
| 4,129,238 | 12/1978 | Herd | 242/75.43 |

*Primary Examiner*—John M. Jillions

*Attorney, Agent, or Firm*—Arthur B. Moore

[57] ABSTRACT

Apparatus for controlling the tension of a web during transport, such as a label-carrying web in a heat transfer labelling machine. The web travels from a supply reel, around a dancer roll and metering roll, through various other web handling devices to another dancer roll, and is collected at a rewind reel. Each dancer roll is linked to a clutch for the corresponding supply or takeup reel, so that each clutch exerts a braking torque determined by the web tension at its dancer roll. Each dancer roll is further linked to an air cylinder to provide a user-determined tension level. The carrier web includes pin holes which are engaged by a pin wheel rotatably mounted to the metering roll, so that the pin wheel swivels when subjected to web tension differentials. Swivelling of the pin wheel opens and closes a valve within the metering roll, thereby providing a variable vent for high pressure air supplied to the supply air cylinder. The system provides automatic adjustment of web tension in response to a tension differential at the metering roll.

16 Claims, 14 Drawing Figures

WEB TENSION CONTROL APPARATUS

BACKGROUND OF THE INVENTION

The present invention relates to web transport systems, and more particularly to apparatus for controlling the tension of a web during transport.

One well known type of decorating apparatus, heat transfer labelling apparatus, transfers decorative labels from a carrier web to articles using heat and pressure. As shown in the prior art plan view of FIG. 1, a typical heat transfer decorator 100 includes apparatus 105 for transporting a label carrier web 150 to a decoration station 160, where an individual label is transferred from the web to an article B by means of a transfer roll 146. In the illustrative web transport 105, the label-carrier web travels from a supply reel 110, around a dancer roll 120, various idler rolls, a metering roll 10, a label preheater 143, a platen and transfer roll 146, a takeup dancer roll 140, to a takeup reel 115. One of the operational prerequisites of the labelling apparatus 100 is that the carrier web 150 be maintained at a controlled, even tension in order to provide smooth web transport, as well as reliable web tension at the decoration site 160.

FIG. 2 shows in a perspective view an advantageous form of tension control apparatus as known in the prior art. The carrier web 150 unwinds from supply reel 110 (shown in phantom), to a dancer roll 120, which moves in an arcuate path in response to tension differentials. The unwind dancer roll 120 is mounted on a dancer lever 122, which in turn is pivotally mounted to a connecting rod 123; the pivot point is assymetrically located, so that the pivoting of lever 122 will induce the axial translation of connecting rod 123. The translation of connecting rod 123 in turn varies the compression of a spring (not shown), thus applying greater or less force to pivoted clutch arm 125. As shown in FIG. 3, clutch arm 125 is pivotally mounted to mounting block 126. The greater the force exerted through clutch arm 125, the greater the engagement pressure between the lower and upper clutch plates 127 and 128, and the greater the frictional restraining torque imposed by the clutch 130. Clutch arm 125 may be rotatably positioned by adjustment bolt 129. This adjustment is used to properly position the range of arcuate travel of the dancer rolls.

The motion of the various mechanisms linked to dancer roll 120 results in variation of the engagement of the clutch 130, which determines the frictional resistance exerted by the clutch to the rotation of supply reel 110, and hence the web tension required to slip the clutch. For example, movement of dancer roll 120 away from decoration site 160 causes connecting rod 123 to push outwardly on clutch arm 125, increasing the pressure between clutch plates and increasing the resisting torque. To maintain a proper tension balance, the resisting torque of the clutch should balance the torque exerted by the web at supply reel 110, which varies with the radius of the supply roll. During normal operation, the dancer roll 120 wil tend to move away from decoration site 160 when the supply roll radius is high, and toward the decoration site 160 when the supply radius is low.

The mechanisms illustrated in FIGS. 2 and 3 are duplicated at takeup reel 115, with the modification that the takeup reel is mounted to a positive drive (not shown) for the web transport. The takeup reel is connected to the positive drive by a slip clutch (not shown) analogous to the braking clutch 130; engagement pressure between the clutch plates at the takeup reel is controlled in similar fashion as at the supply reel 110 thus maintaining proper web tension at the supply reel.

It is desirable to minimize any tension difference across the metering roll 10. This prior art system utilizes a single air cylinder (not shown) to regulate the tension at each dancer lever. For example, in the supply linkage the air cylinder is linked by a lever (not shown) to the pivot connection of dancer lever 122 and connecting rod 123, providing a counterbalance to the torque exerted by the dancer lever 122 (FIG. 2). In order to minimize tension difference across the metering roll, the lengths of the cylinder lever in the supply linkage and corresponding lever in the rewind linkage are relatively adjusted to compensate for the various frictional restraints imposed in the web by idler rolls, contact with heaters, and the like.

A disadvantage of this prior art apparatus is that the mechanical adjustments provided do not automatically compensate for tension variations which occur for various reasons. This has led to a degradation of decoration quality, and in addition has caused mechanical problems in web transport. In particular, a tension differential at the web metering roll 10 can cause a fracture of the web at the feed holes 157.

Accordingly, it is a principal object of the invention to provide an improved web transport system of the general type illustrated in the prior art. A related object is to provide improved tension control apparatus for use in a transport system of this type.

Another object of the invention is to achieve tension control apparatus which effectively compensates for changes in transport parameters during the operation of the transport system. A specific object is that such a tension control system effectively compensate for tension differentials during the unwind and takeup of the web.

A further object of the invention is to provide a web transport system which is easily adjustable by the user, but which does not require constant user surveillance.

Yet another object of the invention is to achieve web tension control apparatus which minimizes mechanical stresses on the web during normal operation.

SUMMARY OF THE INVENTION

The web tension control system of the invention satisfies the above and additional objects by means of apparatus which is compatible with the prior art system of FIGS. 1–3, and which may additionally be applied to other types of web control systems. A first principal element of the control apparatus is a pneumatic assembly which preferably provides separate air pressures to regulate tension control assemblies at the supply and takeup reels. The second principal element is a modified metering roll which incorporates valve apparatus to coordinate any web tension differential at the metering roll with the operation of the pneumatic assembly.

In accordance with one aspect of the invention, the pneumatic assembly provides an input air pressure to one of the tension control assemblies, and a control air pressure to the other tension control assembly. In the preferred embodiment, the input air pressure is routed to a takeup air cylinder and the control pressure to a supply air cylinder. In this embodiment, the linkage to the takeup cylinder advantageously provides a lower tension level than at the supply reel, given equal air pressures to the air cylinders. The metering roll provides a means for lowering the control air pressure to maintain equal tensions at both reels.

In accordance with another aspect of the invention, the metering roll achieves a controlled air leakage, leading to a diminution of internal air pressure. This air leakage reduces the value of the control air pressure. In this preferred embodiment, the magnitude of such leakage is determined by a web tension differential at the metering roll, which differential influences a member which positively engages the web at the metering roll periphery. Any web tension differential causes a swivelling of the web engaging member, which is linked to valving apparatus within the metering roll. In the preferred embodiment, the web engaging member is a pin wheel which is rotatably mounted to the metering roll.

A further aspect of the invention relates to the valving mechanisms within the metering roll, which preferably are compatible with the prior art function of the metering roll of providing a controlled web advance driven from a central shaft. In the preferred embodiment, the metering roll is designed to provide intermittent web advance over user-determined intervals. The internal valving centers around the metering roll shaft, which acts as a conduit for high pressure air from the control air line. Advantageously, this high pressure air is routed from the shaft to a vent orifice which allows the leakage of air to the extent such leakage is not prevented by a sealing structure. This sealing structure is in turn joined to the web engaging member, thereby coordinating the swivelling of the web engaging member to the magnitude of the air leakage.

BRIEF DESCRIPTION OF THE DRAWINGS

The above and additional aspects of the invention are illustrated with reference to the foregoing discussion of the prior art, and the description of the preferred embodiment which follows, taken in conjunction with the drawings in which.

DETAILED DESCRIPTION

Figure 1:
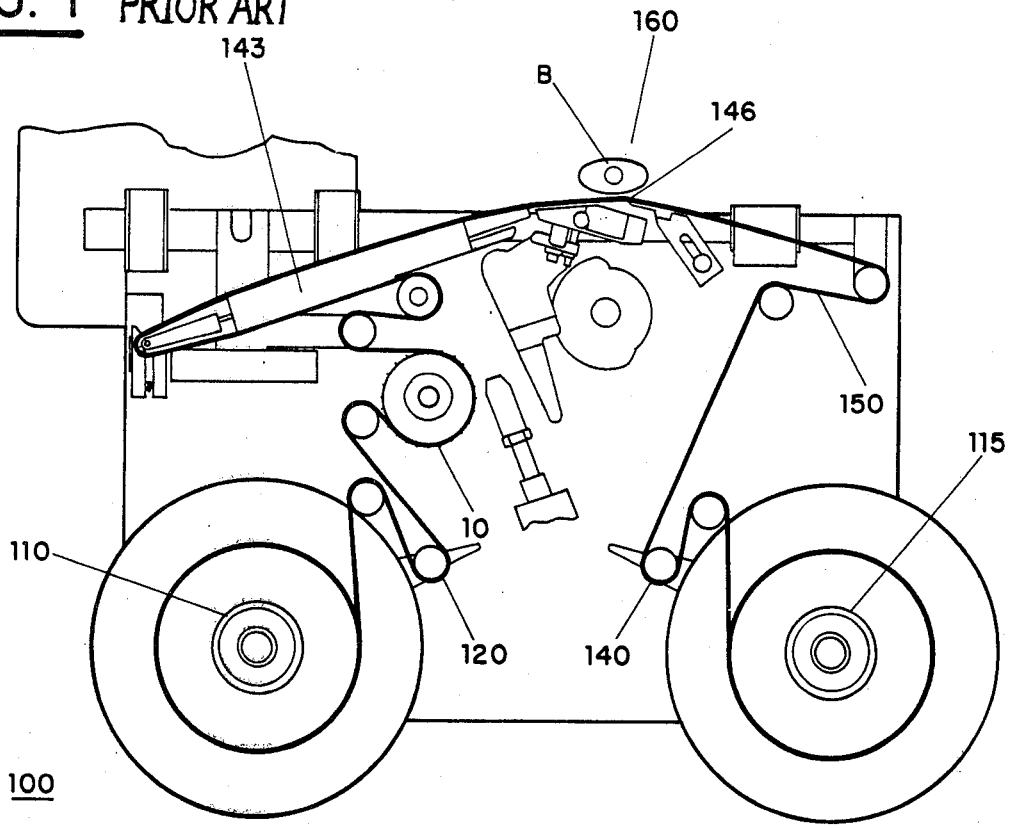
FIG. 1 PRIOR ART
FIG. 1 is a plan view of an illustrative heat transfer labelling machine.
Figure 2:
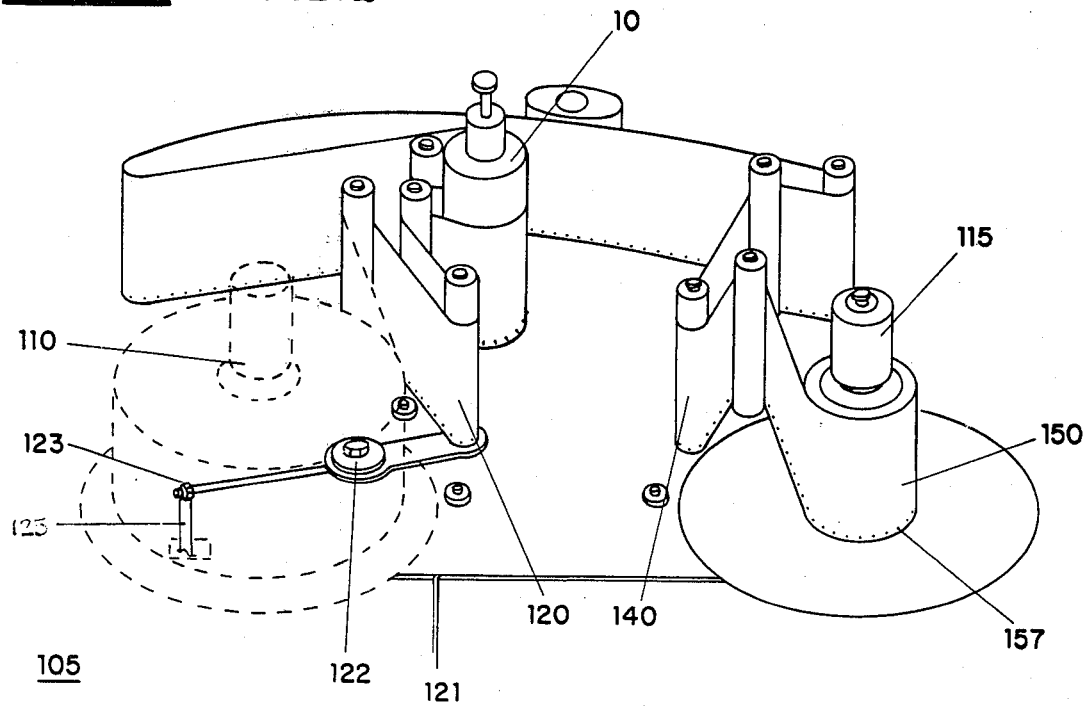
FIG. 2 PRIOR ART
FIG. 2 is a perspective view of tension control mechanisms for the label feed area of FIG. 1, as known in the prior art.
Figure 3:
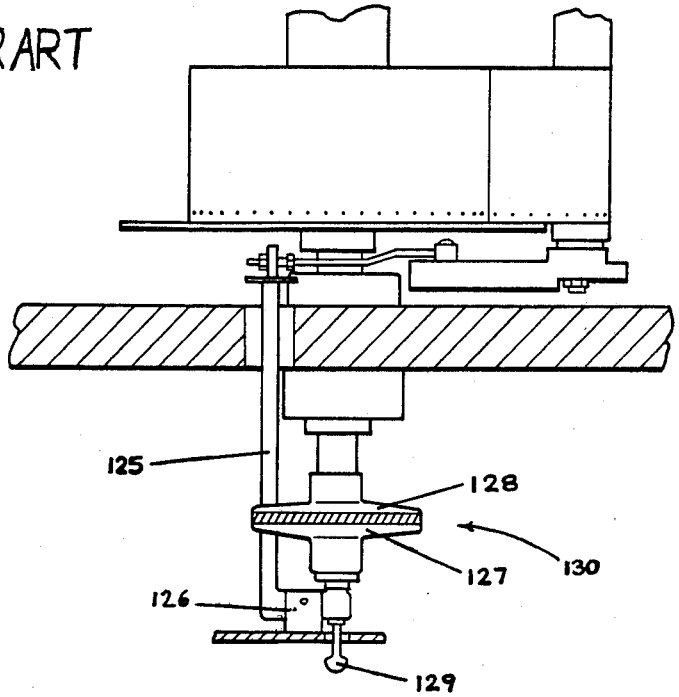
FIG. 3 PRIOR ART
FIG. 3 is an elevation view of the supply reel clutch area of the apparatus of FIG. 2.

The tension control apparatus of the invention is advantageously employed in combination with a web transport system of the type illustrated in FIGS. 1–3, and this combination will be assumed for illustrative purposes. The control apparatus includes a modified metering roll 10, which incorporates valving mechanisms to coordinate a web tension differential at the metering roll with the air pressure to air cylinders associated with the web tension control mechanisms.

Figure 4:
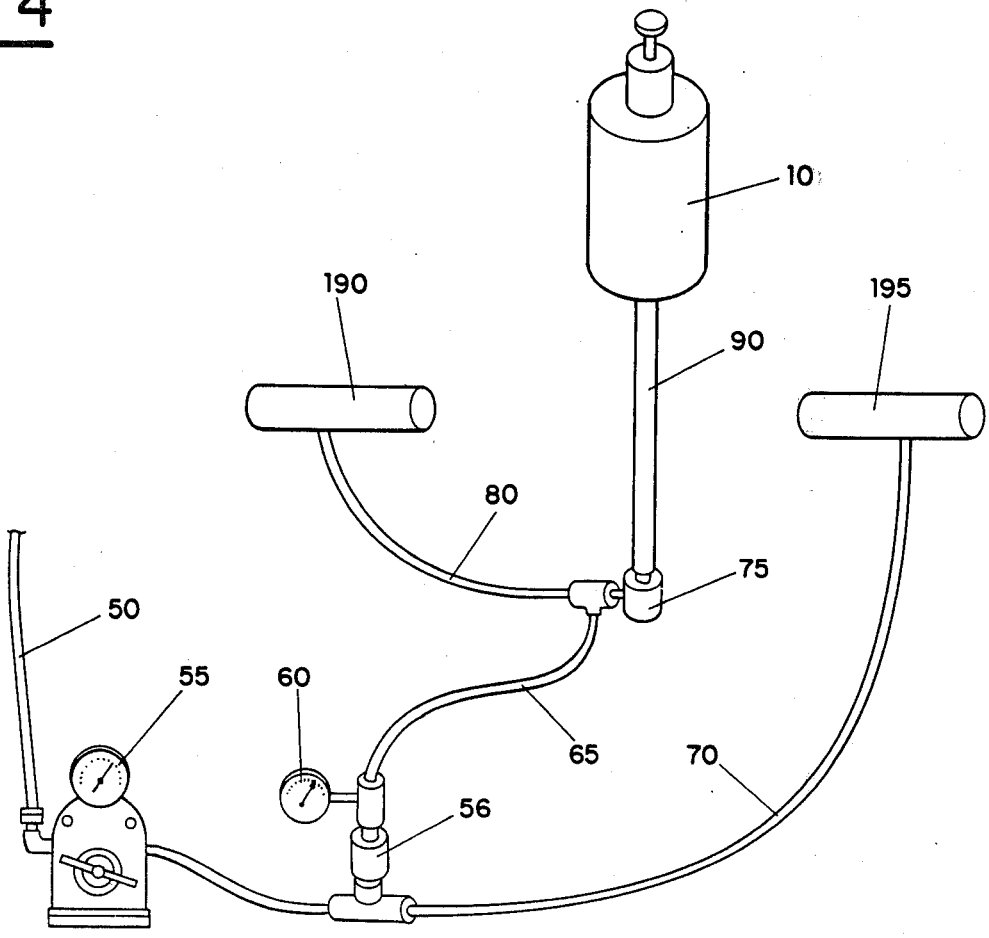
FIG. 4 is a partial schematic view of a pneumatic assembly in accordance with a preferred embodiment of the invention.

A suitable pneumatic system for use in this context is shown in the schematic view of FIG. 4. High pressure air is supplied at a user-determined pressure $P_1$ through an input air hose 50; the input air pressure is monitored on a master gauge 55. This air supply is routed to supply and takeup air cylinders 190 and 195, which regulate the operation of the tension control mechanism. The air is delivered at the input pressure $P_1$ to the takeup air cylinder 195 via air hose 70. High pressure air is also delivered through an adjustable throttling valve 56 and control air hose 65 to a rotary air joint 75, which is mounted at the base of metering roll shaft 90. The air pressure $P_2$ in control air hose 65 is monitored on a control pressure gauge 60. The air pressure $P_2$ monitored on the control gauge 60 will generally be significantly lower than that at the master gauge 55, due to a loss of air through the valving mechanism in metering roll 10, with subsequent pressure drop across a throttling valve 56. This reduced pressure $P_2$ is communicated to the supply air cylinder 190, via the branch air hose 80.

Figure 5:
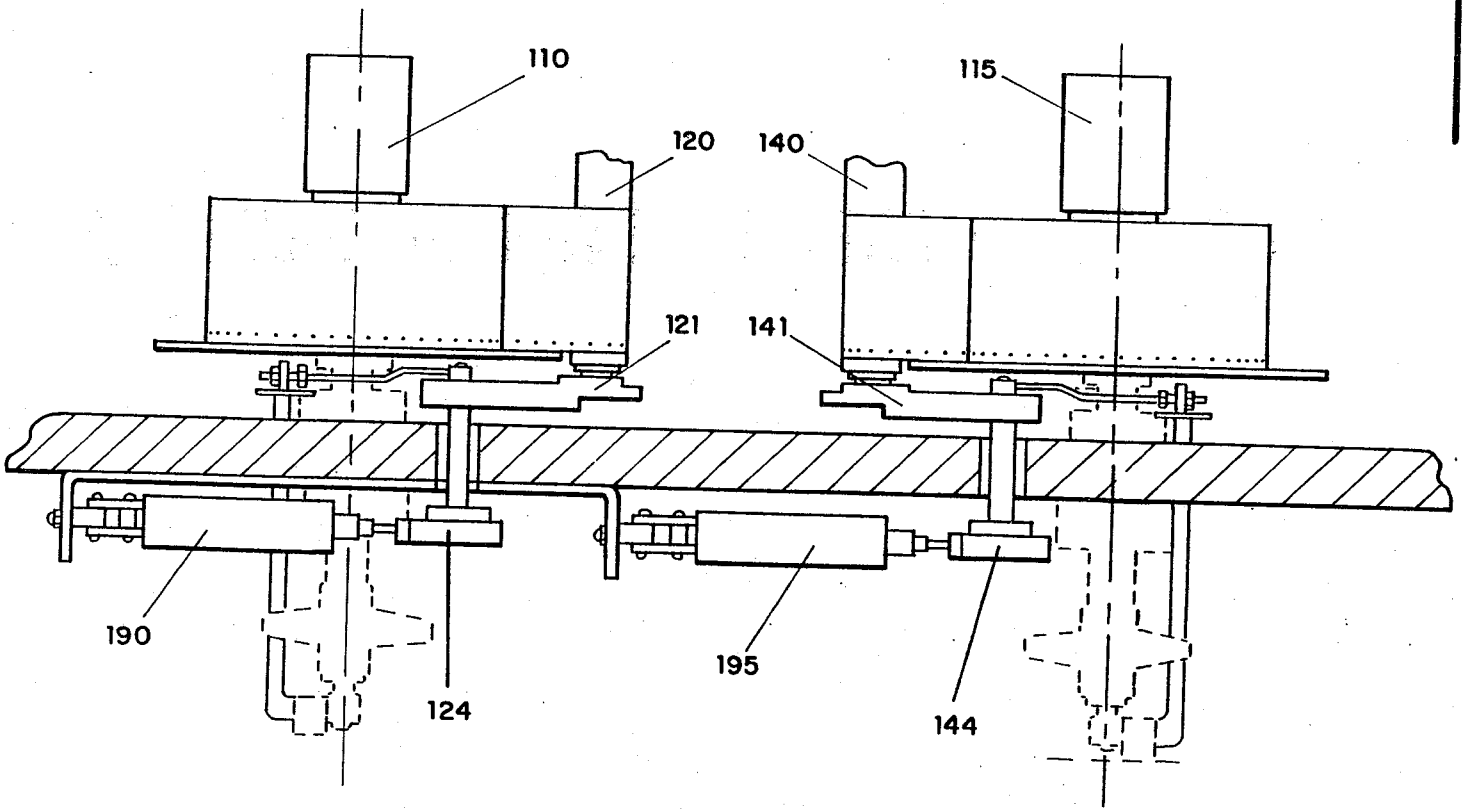
FIG. 5 is a partial elevation view of dual tension control air cylinders in accordance with a preferred embodiment of the invention.

In the preferred embodiment shown in FIG. 5, the lever arm 124 associated with supply cylinder 190 is longer than the corresponding lever arm 144 of the takeup cylinder 195. In view of this characteristic, with all other parameters equal including the air pressure at the two cylinders, the supply web tension will be higher than the takeup web tension. It is therefore necessary in order to equalize these tensions that the air pressure $P_2$ to supply cylinder 190 be lower than the pressure $P_1$ to takeup cylinder 195. This is accomplished by means of controlled air leakage from metering roll 10.

Figure 6:
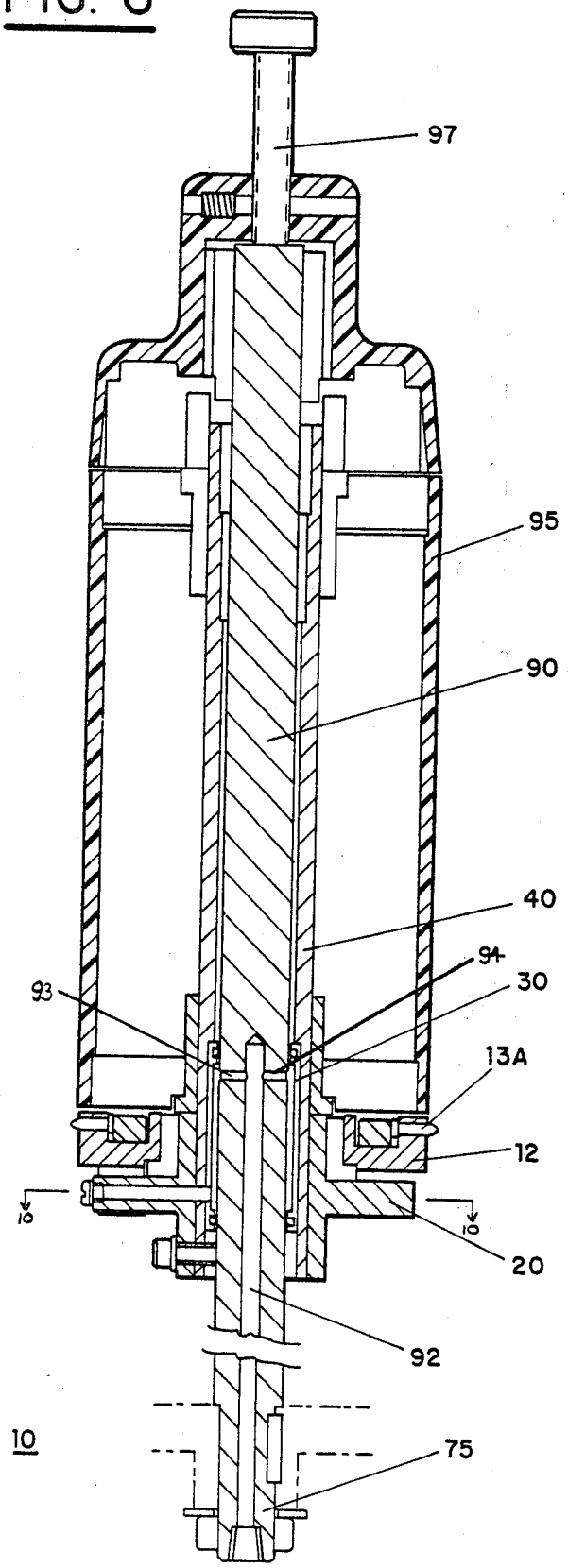
FIG. 6 is a sectional elevation view of a preferred form of metering roll in accordance with the invention.

FIG. 6 shows in section an advantageous internal design of metering roll 10. The metering roll 10 includes a drum 95 rotatably mounted on a central shaft 90. Also mounted on shaft 90 below drum 95 are a pin wheel 12 and various associated structures more fully explained below. Shaft 90 has a central bore 92 to allow passage of air. The shaft extends below the decorator surface, terminating at a rotary joint 75, whereby central bore 92 communicates with air lines 65 and 80 (FIG. 4). Label-carrier web 150 wraps around metering roll drum 95, with the web pin holes 157 registered with individual pins 13A, 13B, etc. of pin wheel 12. Shaft 90 is coupled below the decorator surface to mechanisms for rotating the shaft 90 along with drum 95 and pin wheel 12, thereby providing a controlled advance of the label carrier web 150. Pin wheel 12 is mounted within metering roll 10 and permitted to swivel through a given limited angle. Illustratively, this angle is such as to limit arcuate motion of the pins 13 to about 0.01 inch total travel relative to the remainder of metering roll 10.

Drum 95 is preferably coated with a resilient friction material such as urethane. In the preferred construction of metering roll 10, the drum 95 is locked against rotation relative to shaft 90 by means of a locking screw (not shown), which screw may be removed to permit the drum 95 to slip relative to shaft 90. In the latter case, a frictional brake (not shown) acts as a partial torsional restraint which permits relative drum rotation only when the web tension differential across the metering roll exceeds a prescribed value.

The lower portion of metering roll 10 consists of various mechanisms which are designed: (a) to provide a conduit for air passing through bore 92 to the air leakage valving mechanism, (b) to act as a rotor assembly which rotates relatively to metering roll drum 95, and (c) to allow a controlled leakage of the high pressure air, while coordinating the magnitude of this leakage with any web tension differential at the metering roll. With further reference to the sectional view of FIG. 6, the principal structures to effect these functions (a) and (c) consist of pin wheel 12, air jet collar 20, and gland seal ring 30.

Figure 7:
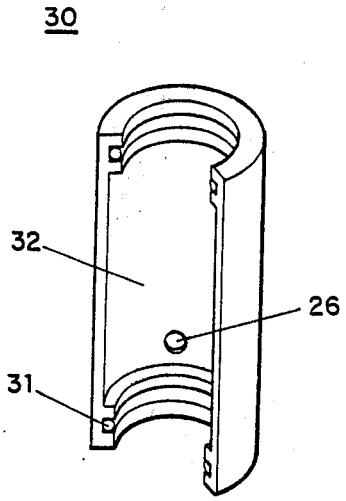
FIG. 7 is a perspective view of a preferred form of gland seal ring for the metering roll of FIG. 6.

High pressure air in the central bore 92 of shaft 90 escapes through ducts 93 and 94 into an annular cavity 32 defined by gland seal ring 30. As shown in the cutaway sectional view of FIG. 7, gland seal ring 30 comprises a cylindrical member which forms a seal at the top and bottom with the periphery of shaft 90 by means of O-rings 31. Gland seal ring 30 is fitted in an indentation within a sleeve 40, on which drum 95 is mounted in bearings 45. Alternatively, gland seal ring 30 and sleeve 40 can be machined as a unitary structure. Sleeve 40 is fitted at its lower periphery to air jet collar 20. High pressure air passes from cavity 32 through a duct 26 in the walls of gland seal ring 30 and sleeve 40, as well as through air jet collar 20.

Figure 9A:
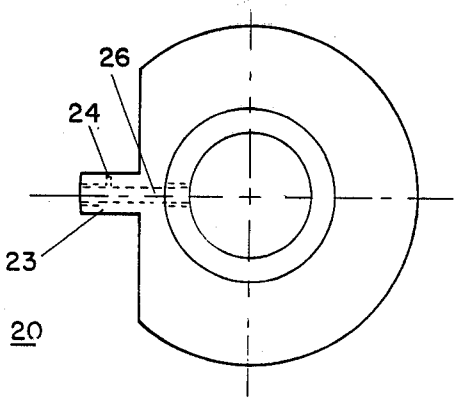
FIG. 9A is a plan view of a preferred form of air jet collar for the apparatus of FIG. 6, as seen from above.
Figure 9B:
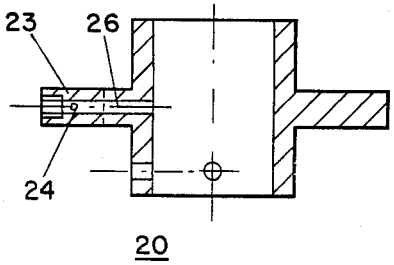
FIG. 9B is a sectional elevation view of the air jet collar of FIG. 9A.

With reference to the sectional view of FIG. 9A, air jet collar 20 consists of a cylindrical structure with a peripheral collar. As shown in FIG. 9B, the collar illustratively comprises a disc with two angular segments removed to define a finger 23. Finger 23 includes the duct 26 as well as a transverse orifice 24 which vents the high pressure air when uncovered.

Figure 8A:
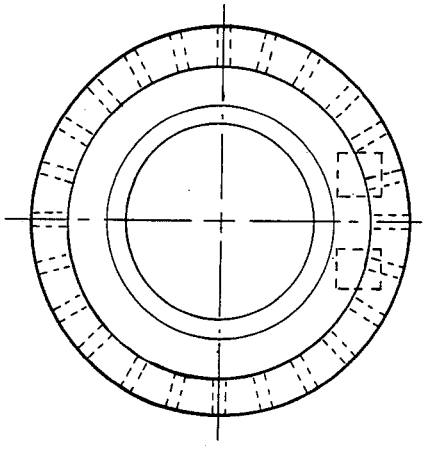
FIG. 8A is a plan view of a preferred form of pin wheel for the apparatus of FIG. 6, as seen from above.
Figure 8B:
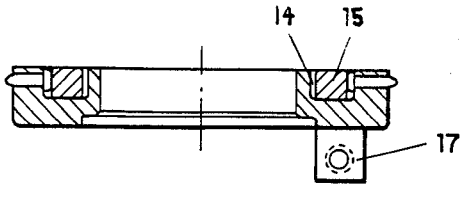
FIG. 8B is a sectional elevation view of the pin wheel of FIG. 8A.
Figure 8C:
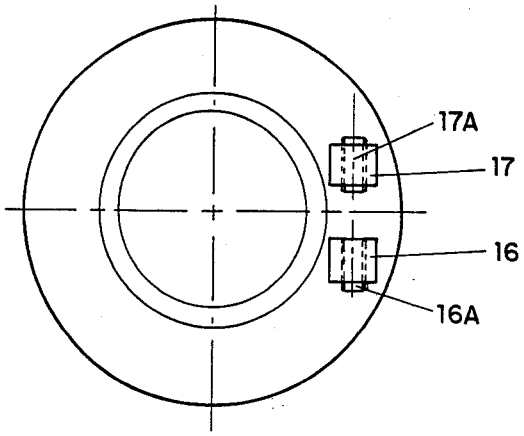
FIG. 8C is a plan view of the pin wheel of FIG. 8A, as seen from below.

The metering roll 10 incorporates a pin wheel 12 comprising a ring-like structure carrying a peripheral series of pins **13*a*, 13*b*, etc. (FIGS. 8A–8C). A retaining ring 15 is housed in an annular cavity 14 to contain the pins 13. Pin wheel 12 is rotatably coupled to air jet collar 20 by a bearing 25 (FIG. 6). As shown in FIGS. 8A and 8B, two lugs 16 and 17 carrying set screws 16*a* and 17*a* are appended to the lower face of pin wheel 12. Although the preferred tension control apparatus employs a metering roll 10 and pin wheel 12** to register the web, these devices may be replaced with equivalent structures to mechanically register the web. The important aspect in this regard is that such a device positively respond to web tension differentials.

Figure 10:
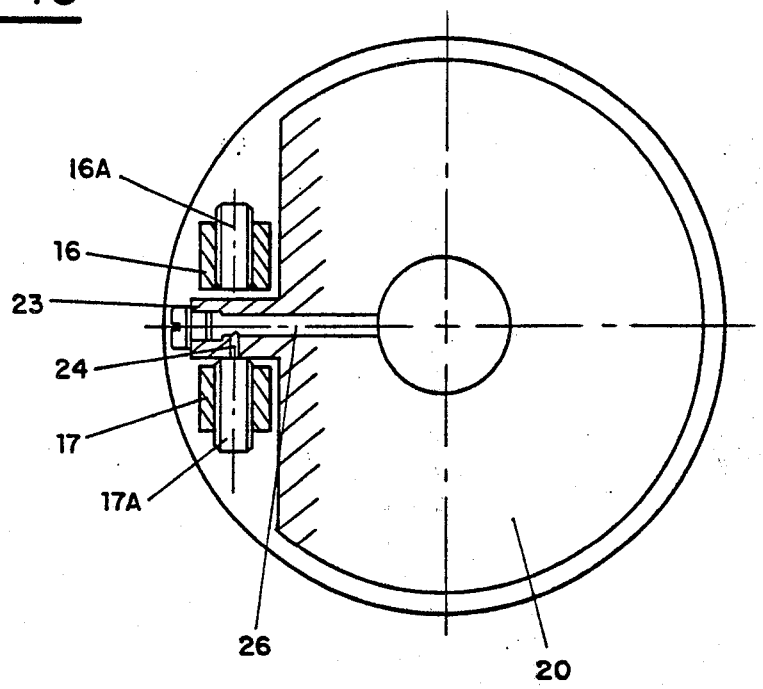
FIG. 10 is a sectional view of the pin wheel-air jet collar interface of the metering roll of FIG. 6 in a section taken through the lines 10—10, as seen from below.

As shown in the sectional view of FIG. 10 as seen from below, the pin wheel 12 is mated to the air jet collar 20 so that the finger 23 rests between lugs 16 and 17. Lugs 16 and 17 delimit the rotation of the pin wheel 12 relative to the air jet collar when one of the set screws **16*a* and 17*a* impacts the adjacent wall of finger 23. When pin wheel 12 is at its counterclockwise extreme as seen from above, set screw 17*a* rests flush against the wall of finger 23, completely covering the vent orifice 24 and effectively sealing in high pressure air. When the pin wheel 12 is at its clockwise extreme, the set screw 17*a* is sufficiently separated from vent orifice 24 to permit virtually unimpeded venting. Because of the direction in which the carrier web 150 is wrapped around metering roll 10 (FIG. 1), a relatively high web tension in the takeup direction will induce a counterclockwise swivelling of pin wheel 12, and hence will tend to close the vent orifice 24. Similarly, a relatively low supply tension will also close vent orifice 24. The same effects could be accomplished with an opposite wrap of web 150 and an opposite facing of vent orifice 24**.

Figure 11:
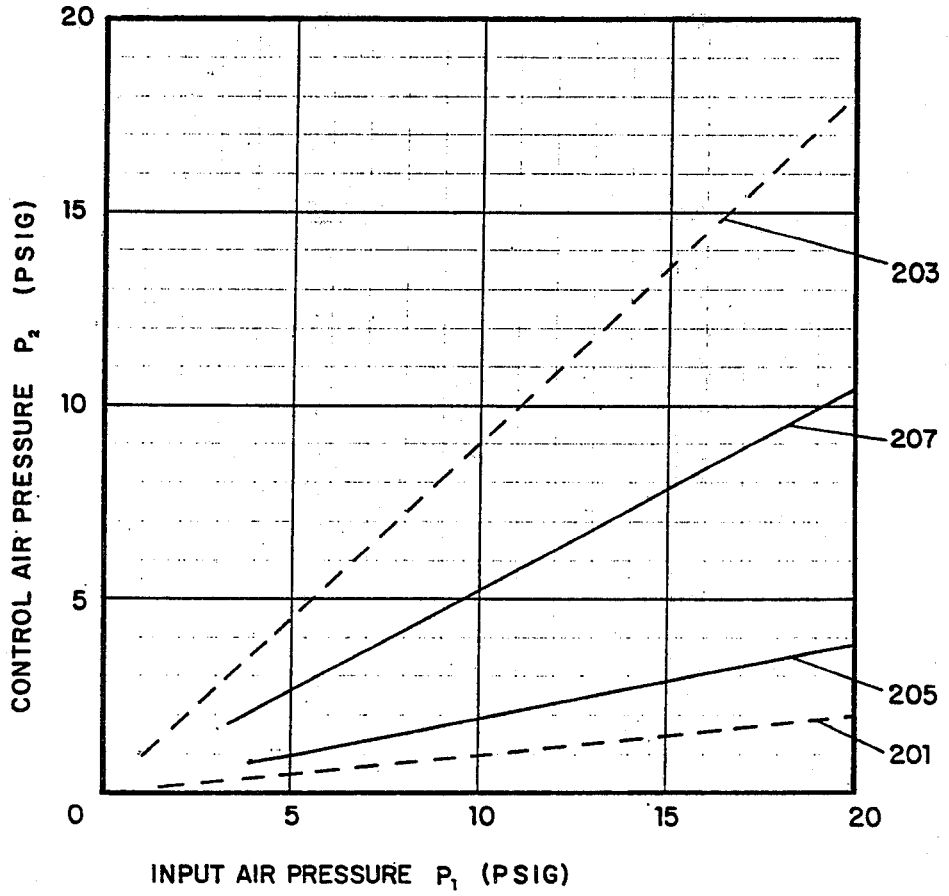
FIG. 11 is an illustrative plot of control air pressure as a function of input air pressure for web tension control apparatus of the type illustrated in FIGS. 5 and 6.

FIG. 11 gives a plot of control pressure $P_2$ registered on gauge 60 as a function of input air pressure $P_1$ registered on gauge 55 (FIG. 4). The dotted line 203 gives the range of relative pressure values with the vent orifice 24 completely closed, while dotted line 201 gives the range of values with the vent orifice completely open. It may be seen that, depending on the disposition of the valving mechanisms within metering roll 10, the control pressure $P_2$ could vary between a maximal value somewhat less than the input air pressure $P_1$ to a minimum value somewhat greater than 0.

In practice, during normal operation of the decorating apparatus 100, the control pressure with typically fluctuate between values such as those indicated by solid lines 205 and 207 as the system responds to any web tension differential across the metering roll and acts to reduce this tension differential to 0. A typical cycle of the web tension control apparatus involves the following stages. A relatively high takeup tension will cause the counterclockwise rotation of pin wheel 12, tending to close the vent orifice 24. This results in an increase of control air pressure $P_2$, and an increase of supply web tension to a point at which it is essentially equal to the takeup web tension. Should the supply web tension be too high, pin wheel 12 will rotate in the clockwise direction, tending to open vent orifice 24. This results in a decrease of control air pressure $P_2$, and a decrease of supply web tension to a point at which it is essentially equal to the takeup web tension.

The operating cycles described above pertain to an arrangement in which the drum 95 can rotate relative to the rest of the metering roll, albeit under the moderate restraint of the friction brake acting on the drum. Where the drum is locked against rotation relative to the rest of the metering roll, a somewhat different mode of operation is encountered. Assuming negligible slippage between the web and the drum, an increase in supply web tension will stretch the web increasing the distance between the pin holes in the web as the web runs into the metering roll. Each web pin hole will arrive a little behind its corresponding pin on the pin wheel. This will cause the pin wheel to be rotated in the clockwise direction, opening vent orifice 24. This results in a decrease of control air pressure $P_2$ and a decrease of supply web tension to a point where the distance between the pin holes in the web exactly matches the corresponding distance between pins in the pin wheel. If the supply tension is too low, the reverse action occurs.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. All references to clockwise and counterclockwise rotation assume a view from above unless otherwise noted. Although the web tension control apparatus has been illustrated in the context of given prior art tension adjusting mechanisms, it may be effectively employed with other pneumatically-regulated mechanisms as well. The control apparatus is advantageously utilized in any web transport system in which web advance is mechanically registered at a metering structure.

I claim:

1. Improved web transport apparatus, of the type including web dispensing means, means for regulating the web tension at the web dispensing means, web takeup means, means for regulating the web tension at the web takeup means, and a metering device for engaging the web and controlling its advance from the web dispensing means to the web takeup means, wherein the improvement comprises improved tension control apparatus including:

a first pneumatic assembly, for controlling the dispensing tension regulating means in response to a first air pressure;

a second pneumatic assembly, for controlling the takeup tension regulating means in response to a second air pressure;

a web engaging member mounted to said metering device to move in response to a tension differential of the engaged web; and a valve assembly within said metering device actuated by the movement of said web engaging member to vary the air pressure to at least one of said pneumatic assemblies.

2. Apparatus as defined in claim 1, wherein each pneumatic assembly comprises:

an air cylinder;

an air supply to said air cylinder for providing air under greater than ambient pressure; and mechanical linkage from said air cylinder to said web tension regulating means to increase the web tension in response to an increase in air pressure at said air cylinder.

3. Apparatus as defined in claim 2 wherein the web tension at said web dispensing means is greater than the web tension at said web takeup means when the air pressure at the dispensing air cylinder equals the air pressure at the takeup air cylinder, and wherein the valve assembly within said metering device decreases the air pressure at the dispensing air cylinder in response to a relatively high tension in the dispensing direction of said web at said metering device.

4. Apparatus as defined in claim 2 wherein the web tension at said web dispensing means is greater than the web tension at said web takeup means when the air pressure at the takeup air cylinder equals the air pressure at the dispensing air cylinder, and wherein the valve assembly within said metering device decreases the air pressure at the takeup air cylinder in response to a relatively high tension in the takeup direction of said web at said metering device.

5. Apparatus as defined in claim 1 of the type wherein said metering device comprises a cylinder, wherein said web engaging member is mounted to a circumference of said cylinder to pivot around the cylinder axis, and said valve assembly comprises:

means for routing air at greater than ambient pressure from at least one of said pneumatic assemblies to a venting orifice with said metering cylinder;

and sealing means responsive to the pivoting of the web engaging member for controlling the venting of air from said venting orifice.

6. Apparatus as defined in claim 5 wherein said web engaging member comprises a pin wheel carrying a plurality of pins to engage pinholes in said web, and said sealing means comprises a sealing member appended to said pin wheel and contiguous to said venting orifice, and wherein rotation of said pin wheel relative to said metering cylinder varies the separation of said sealing member from said venting port.

7. Apparatus as defined in claim 5 wherein said routing means comprises:

a central shaft for said metering cylinder, said central shaft including a conduit from said air source to a port in the periphery of said shaft;

a member mounted around the central shaft, said member defining a chamber into which air passes from the port, and further including a channel connecting the chamber to the venting orifice.

8. Improved web transport apparatus comprising:

means for guiding a web during transport;

means for regulating the web tension in said guiding means;

means for providing a pneumatic signal;

means for controlling the operation of said tension regulating means in response to the pneumatic signal;

wherein said guiding means includes a metering cylinder, a web engaging member mounted to a circumference of said metering cylinder to pivot in response to a tension differential of the engaged web, and a valve assembly actuated by the pivoting of said web engaging member to alter said pneumatic signal.

9. Apparatus as defined in claim 8, wherein the means for providing a pneumatic signal comprises an air supply for providing air under greater than ambient pressure, and the controlling means includes an air cylinder actuated by said air supply, mechanical linkage from said air cylinder to said web tension regulating means to increase the web tension in response to an increase in air pressure at said air cylinder.

10. Apparatus as defined in claim 8, wherein said valve assembly comprises:

means for routing air at greater than ambient pressure from at least one of said pneumatic assemblies to a venting orifice within said metering cylinder; and sealing means responsive to the pivoting of the web engaging member for controlling the venting of air from said venting orifice.

11. Apparatus as defined in claim 10 wherein said web engaging member comprises a pin wheel which is relatively rotatable with respect to said metering cylinder, and said sealing means comprises a sealing member appended to said pin wheel and contiguous to said venting orifice, and wherein rotation of said pin wheel relative to said metering cylinder varies the separation of said sealing member from said venting port.

12. Apparatus as defined in claim 10 wherein said routing means comprises:

a central shaft for said metering cylinder, said central shaft including a conduit from said air source to a port in the periphery of said shaft;

a member mounted around the central shaft, said member defining a chamber into which air passes from the port, and further including a channel connecting the chamber to the venting orifice.

13. Apparatus as defined in claim 9 wherein the web advances from dispensing means to takeup means, and wherein an increase of air pressure to said air cylinder causes an increase of web tension intermediate the dispensing means and metering cylinder.

14. Apparatus as defined in claim 13, wherein a relatively high web tension at said web engaging member in the direction of the dispensing means actuates said valve assembly to decrease said air pressure.

15. Apparatus as defined in claim 9, wherein the web advances from dispensing means to takeup means, and wherein an increase of air pressure to said air cylinder causes an increase of web tension intermediate the takeup means and metering cylinder.

16. Apparatus as defined in claim 15, wherein a relatively high web tension at said web engaging member in the direction of the takeup means actuates said valve assembly to decrease said air pressure.

* * * * *